US011850500B2

(12) United States Patent
Monica

(10) Patent No.: US 11,850,500 B2
(45) **Date of Patent: *Dec. 26, 2023**

(54) PROTECTIVE EQUIPMENT

(71) Applicant: Theodore Anthony Monica, East Stroudsburg, PA (US)

(72) Inventor: Theodore Anthony Monica, East Stroudsburg, PA (US)

(73) Assignee: XTECH PROTECTIVE EQUIPMENT, LLC, East Hanover, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/837,136

(22) Filed: Jun. 10, 2022

(65) Prior Publication Data

US 2022/0296984 A1 Sep. 22, 2022

Related U.S. Application Data

(63) Continuation of application No. 16/691,080, filed on Nov. 21, 2019, which is a continuation-in-part of application No. 15/616,394, filed on Jun. 7, 2017, now Pat. No. 10,517,336, which is a continuation-in-part of application No. 15/405,518, filed on Jan. 13, 2017, now Pat. No. 9,802,103, which is a continuation of application No. 14/942,813, filed on Nov. 16, 2015, now Pat. No. 9,635,890, which is a continuation of application No. 14/467,871, filed on Aug. 25, 2014, now Pat. No. 9,238,167.

(60) Provisional application No. 62/475,938, filed on Mar. 24, 2017, provisional application No. 61/869,487, filed on Aug. 23, 2013.

(51) Int. Cl.

| | |
|---|---|
| ***A63B 71/12*** | (2006.01) |
| ***A41D 13/015*** | (2006.01) |
| ***A41D 27/26*** | (2006.01) |
| ***A41D 13/05*** | (2006.01) |

(52) U.S. Cl.

CPC ..... *A63B 71/12* (2013.01); *A41D 13/015* (2013.01); *A41D 13/0512* (2013.01); *A41D 27/26* (2013.01)

(58) Field of Classification Search

CPC ..... A41D 13/0518; A41D 13/0531; A41D 13/0512; A41D 27/26; A63B 71/12

See application file for complete search history.

(56) References Cited

U.S. PATENT DOCUMENTS

| | | | | |
|---|---|---|---|---|
| 3,158,871 A * | 12/1964 | Morgan | ..... | A63B 71/12 2/462 |
| 3,366,970 A * | 2/1968 | Morgan | ..... | A63B 71/12 D29/101.2 |
| 3,431,560 A * | 3/1969 | Austin | ..... | A63B 71/12 2/465 |

(Continued)

*Primary Examiner* — Gloria M Hale

(74) *Attorney, Agent, or Firm* — Antonio Papageorgiou; Lombard & Geliebter LLP

(57) ABSTRACT

The present application provides a protective apparatus that includes a left and a right generally arched shaped portion with a foam padding system. The foam padding system comprising an adjustable channel that accommodates a shape of a shoulder, the foam padding system including a shoulder pad removably attached to an upper end of at least one of the generally arched shaped portions, and a pair of adjustable body pads removably attached to beneath the shoulder pad in a variable configuration that creates the adjustable channel.

19 Claims, 19 Drawing Sheets

(56) References Cited

U.S. PATENT DOCUMENTS

| | | | | | |
|---|---|---|---|---|---|
| 3,981,027 | A * | 9/1976 | Anderson | A63B 71/12 | 2/462 |
| 4,295,227 | A * | 10/1981 | Mitchell | A63B 71/12 | 2/468 |
| 4,698,845 | A * | 10/1987 | Cosby | A63B 71/12 | 2/465 |
| 5,173,964 | A * | 12/1992 | Ball | A63B 71/12 | 2/463 |
| 7,506,384 | B2 * | 3/2009 | Ide | A63B 71/12 | 2/459 |
| 7,765,624 | B1 * | 8/2010 | Larson | A41D 27/26 | 2/459 |
| 9,238,167 | B2 * | 1/2016 | Monica | A63B 71/12 | |
| 9,635,890 | B2 * | 5/2017 | Monica | A63B 71/12 | |
| 9,802,103 | B2 * | 10/2017 | Monica | A41D 13/0512 | |
| 10,517,336 | B2 * | 12/2019 | Monica | A41D 13/015 | |
| 11,192,018 | B2 * | 12/2021 | Monica | A41D 13/015 | |
| 11,383,149 | B2 * | 7/2022 | Monica | A41D 27/26 | |

* cited by examiner

Fig. 4A
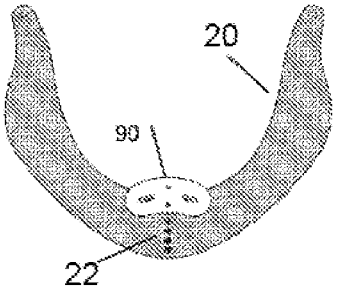
Fig. 4B
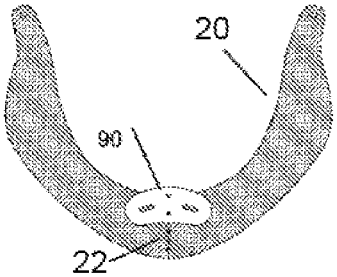
Fig. 4C
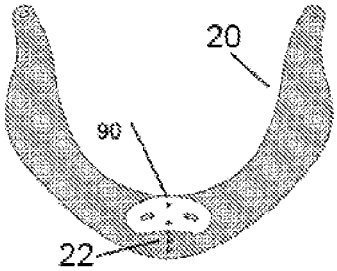
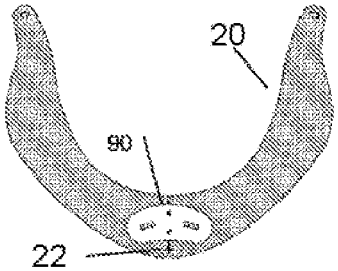
Fig. 4D
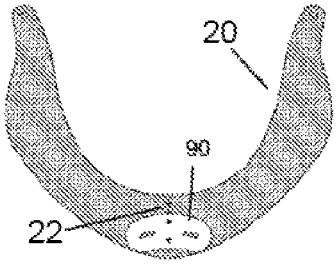
Fig. 4E
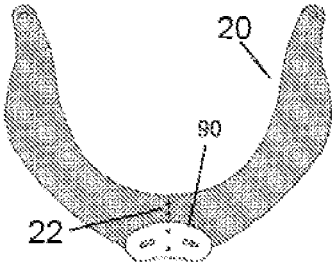
Fig. 4F Fig. 12A
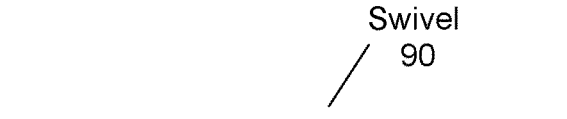
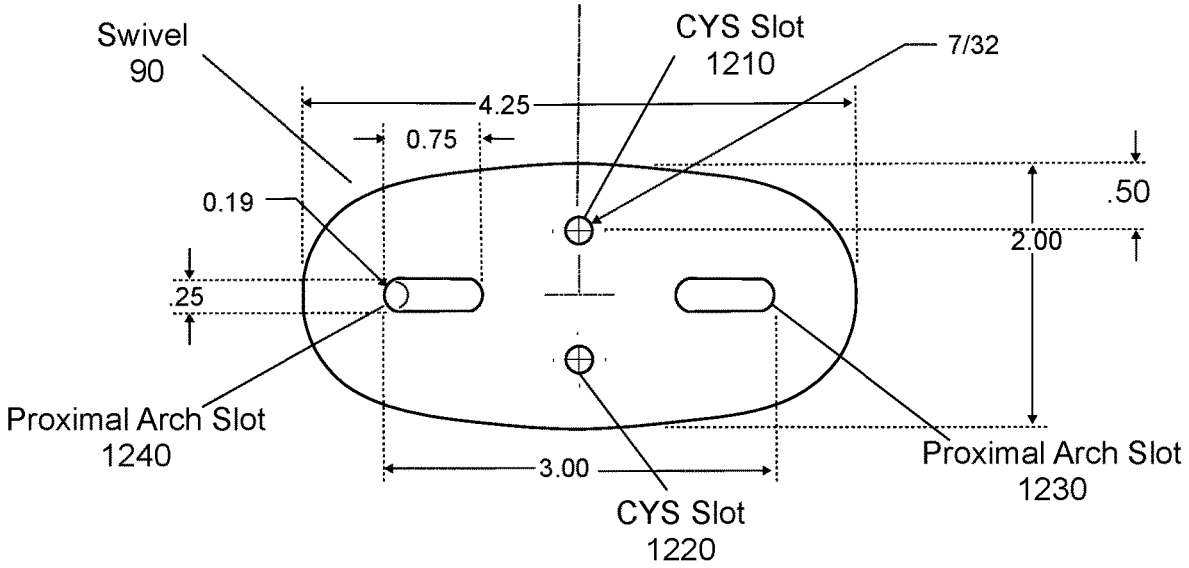
Fig. 12B

PROTECTIVE EQUIPMENT

CROSS REFERENCE TO RELATED APPLICATION

This application is a continuation of U.S. patent application Ser. No. 16/691,080, entitled "PROTECTIVE EQUIPMENT", filed on Nov. 21, 2019, issued as U.S. Pat. No. 11,383,149 on Jul. 12, 2022, which is a continuation-in-part of U.S. patent application Ser. No. 15/616,394, entitled "PROTECTIVE EQUIPMENT", filed on Jun. 7, 2017, issued as U.S. Pat. No. 10,517,336 on Dec. 31, 2019, which claims priority to U.S. Provisional Application No. 62/475,938, entitled "PROTECTIVE EQUIPMENT", filed on Mar. 24, 2017 and which is a continuation-in-part of U.S. patent application Ser. No. 15/405,518, entitled "PROTECTIVE EQUIPMENT", filed on Jan. 13, 2017, issued as U.S. Pat. No. 9,802,103 on Oct. 31, 2017, which is a continuation of U.S. patent application Ser. No. 14/942,813, entitled "PROTECTIVE EQUIPMENT", filed on Nov. 16, 2015, issued as U.S. Pat. No. 9,635,890 on May 2, 2017, which is a continuation of U.S. patent application Ser. No. 14/467,871, entitled "PROTECTIVE EQUIPMENT", filed on Aug. 25, 2014, issued as U.S. Pat. No. 9,238,167 on Jan. 19, 2016, which claims priority to U.S. Provisional Application No. 61/869,487 filed on Aug. 23, 2013, the disclosures of which are hereby incorporated by reference in their entirety.

BACKGROUND OF THE INVENTION

The invention described herein generally relates to athletic protective equipment, and in particular, improved padding systems for athletic protective equipment.

Many contact sports require protective devices to guard against injury because of the violent bodily contact that is involved. One of the customary protective devices is a specialized piece of equipment in the form of shoulder pads which are traditionally worn over the shoulders. These types of shoulder pads have long been known and used. However, the high forces of impact which can be encountered when playing such sports has caused injuries due to the fact that the high force of impact is concentrated over the area of an impact, especially the acromioclavicular area of the shoulder. The concentration of the energy from the forces of impact transmitted to the acromioclavicular area of the shoulder by the conventional cantilever strap causes such shoulder injuries.

It should be noted that due to the nature of the sport of football, as well as other contact sports, no protective equipment, such as shoulder pads, can prevent injuries; however, it is believed that such equipment can be designed to better protect the player from injuries. Existing equipment do not adequately protect the player from the occurrence and severity of injuries to his shoulders, and particularly the acromioclavicular area of the player's shoulder. There is thus a need for protective equipment that disperses energy from contact throughout the entire shoulder pad, as opposed to a traditional cantilever which disperses energy on only one side of the shoulder pad.

SUMMARY OF THE INVENTION

One embodiment of the present application provides a protective apparatus that includes a left generally arched shaped portion; a right generally arched shaped portion; and a foam padding system. The foam padding system includes an adjustable channel that accommodates a shape of a shoulder, the foam padding system including a shoulder pad removably attached to an upper end of at least one of the generally arched shaped portions, and a pair of adjustable body pads removably attached to beneath the shoulder pad in a variable configuration that creates the adjustable channel.

In at least one embodiment, the pair of adjustable body pads includes a front body pad including a shape that follows the at least one of the generally arched shaped portions.

In at least one embodiment, the front body pad comprises an extension pad attached to a distal end thereof, and wherein the extension pad has a hinge that is essentially parallel to a proximal edge of the body pad.

In at least one embodiment, the front body pads comprise a plurality of hinges at an upper end of the pad that are essentially parallel with a lateral axis of the shoulder pad.

In at least one embodiment, at least one of the plurality of hinges delineates a hook and loop section for attaching the body pad to the shoulder pad.

In at least one embodiment, the pair of adjustable body pads is configurable in an adjustable angle relative to each other at the upper end.

In at least one embodiment, the protective apparatus further comprises a cantilever yoke system attached to each of the left and right generally arched shaped portions, and wherein the foam padding system is removably attached to an inside or bottom of the cantilever yoke system.

In at least one embodiment, the pair of adjustable body pads includes a front body pad including a shape that resembles a portion of the cantilever yoke system.

In at least one embodiment, the shoulder pad comprises a plurality of lateral hinges.

In at least one embodiment, the plurality of lateral hinges are essentially parallel to a lateral axis of the shoulder pad.

In at least one embodiment, the plurality of hinges are equally spaced from the lateral axis.

In at least one embodiment, the plurality of hinges are spaced about 1 inch to about 3 inches from each other.

In at least one embodiment, the protective apparatus further comprises one or more swivels having a plurality of elongated slots therein, the left generally arched shaped portion pivotally coupled to the right generally shaped portion at an attachment point at least one of a front and a rear of the apparatus, the one or more swivels slidingly coupled to the left generally arched shaped portion via a first of the elongated slots and to the right generally arched shaped portion via a second of the elongated slots, the plurality of the elongated slots limit pivotal movement about the attachment point.

In at least one embodiment, at least one of the left and right generally arched shape portions comprise a distal arch coupled to a proximal arch, and wherein the at least one shoulder pad is coupled to the distal arch.

In at least one embodiment, the protective apparatus further comprises a cantilever yoke system having a left arch slot, a right arch slot, and one or more swivel slots, the left generally arched shaped portion slidingly coupled to the cantilever yoke system at the left arch slot, the right generally arched shaped portion slidingly coupled to the cantilever yoke system at the right arch slot, and the one or more swivels coupled to the cantilever yoke system at the one or more swivel slots, and wherein slots in at least one of the cantilever yoke system and in the left and right generally arched shaped portions further limit pivotal movement of the left and right portions.

In at least one embodiment, the one or more swivels connect the left and right portions of the apparatus to each other on a rear of the left and right portions, the cantilever yoke system further coupled to at least one of the one or more swivels on a rear of the apparatus at the one or more swivel slots.

In at least one embodiment, each of the left and right portions comprise a distal and a proximal arch fixedly coupled to each other and wherein an apex of the proximal arch is located above an apex of the distal arch such that a space is maintained between the proximal and distal arches.

In at least one embodiment, the apex of each of the proximal and distal arches curves laterally outward such that apexes of the proximal and distal arches form an external cantilever system.

In at least one embodiment, the protective apparatus further comprises a second generally U-shaped shoulder pad layered below the first shoulder pad.

In at least one embodiment, the protective apparatus further comprises at least one of the pair of body pads have a plurality of apertures therein that align with a plurality of apertures in the generally arch shaped portions.

Additional aspects of the present invention will be apparent in view of the description which follows.

BRIEF DESCRIPTION OF THE FIGURES

FIG. 4A through 4F illustrate swivel configurations on cantilever yoke systems according to embodiments of the present invention;

FIG. 12A illustrates a side view of a swivel according to an embodiment of the present invention;

FIG. 12B illustrates a top view of a swivel according to an embodiment of the present invention;

DETAILED DESCRIPTION OF THE INVENTION

Subject matter will now be described more fully hereinafter with reference to the accompanying drawings, which form a part hereof, and which show, by way of illustration, exemplary embodiments in which the invention may be practiced. Subject matter may, however, be embodied in a variety of different forms and, therefore, covered or claimed subject matter is intended to be construed as not being limited to any example embodiments set forth herein; example embodiments are provided merely to be illustrative. It is to be understood that other embodiments may be utilized and structural changes may be made without departing from the scope of the present invention. Likewise, a reasonably broad scope for claimed or covered subject matter is intended. The following detailed description is, therefore, not intended to be taken in a limiting sense.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of exemplary embodiments in whole or in part.

Figure 1:
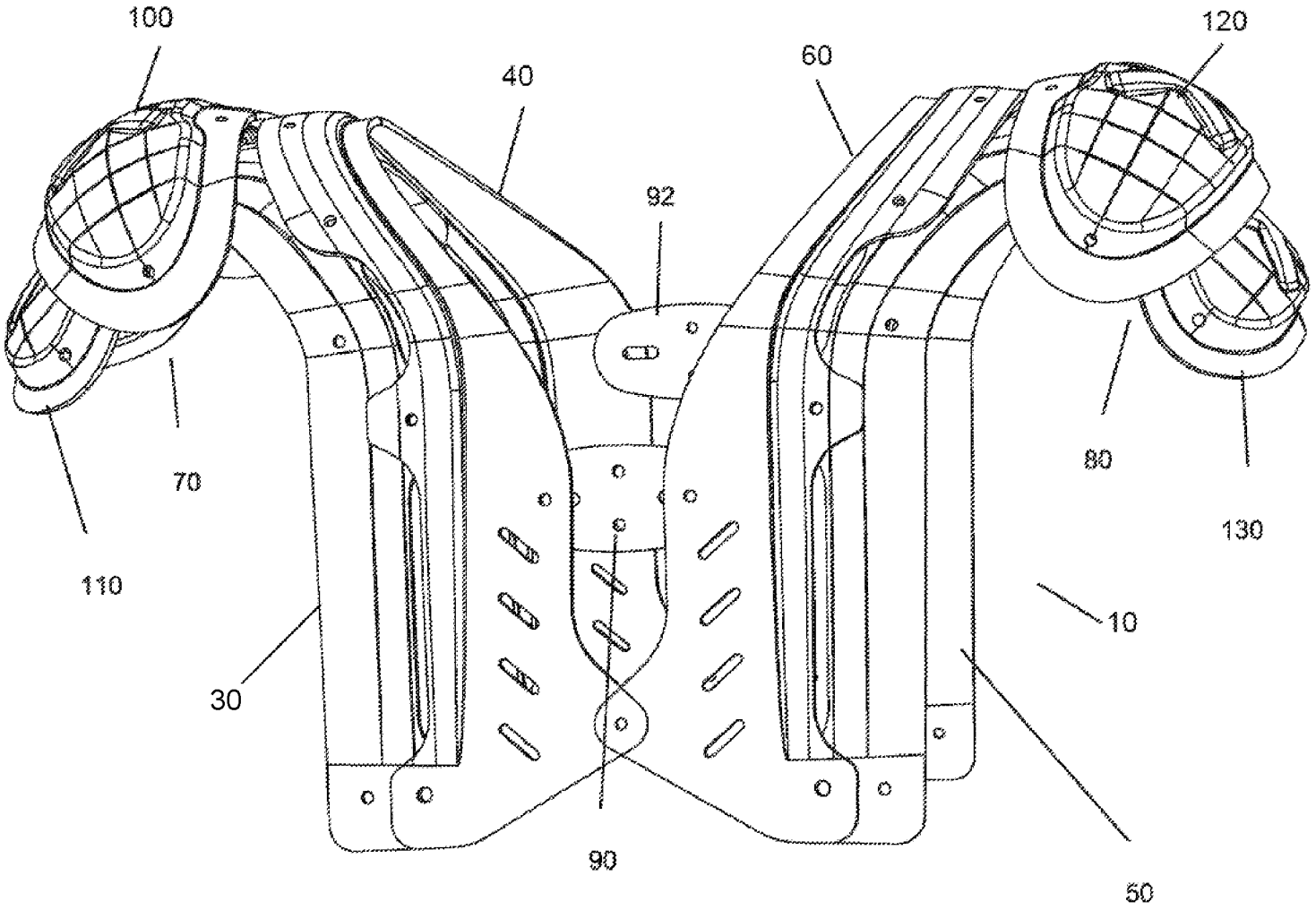
FIG. 1 illustrates a rear-right perspective view of a protective apparatus according to an embodiment of the present invention.

FIG. 1 presents a perspective view of the protective apparatus 10 according to an embodiment of the present invention. The protective apparatus 10 includes a left distal arch 30, a left proximal arch 40, right distal arch 50, right proximal arch 60, left shoulder pad 70 and right should pad 80. The proximal and distal arches are preferably fixedly coupled to each other. Left shoulder pad 70 is comprised of left epaulet 100 and left cup 110. Right shoulder pad 80 is comprised of right epaulet 120 and right cup 130. Left shoulder pad 70, left distal arch 30 and left proximal arch 40 may be coupled to form a left portion of protective apparatus 10. Right shoulder pad 80, right distal arch 50 and right proximal arch 60 may be coupled to form a right portion of protective apparatus 10. The left and right portions of protective apparatus 10 can be joined via a swivel 90 and swivel 92 which allow the portions to move closer and farther away from each other laterally (from left to right and right to left). The two portions of the apparatus 10 may also be hinged to each other. In this instance, the swivel 90 and/or 92 limit the lateral and consequently the pivotal movement of the left and right portions. The bottoms of the distal arches may be secured to each other with a belt and buckle assembly. The attachment of each part of the belt and buckle assembly are preferably such that the belt can pivot or otherwise rotate about a hole in the, e.g., distal arches.

FIG. 1 presents a perspective view of the protective apparatus 10 according to an embodiment of the present invention. The protective apparatus 10 includes a left generally arched shape 12 and a right generally arched shape 14. The left generally arched shape 12 may comprise a left distal arch 30 and a left proximal arch 40, and the right generally arched shape 14 may comprise a right distal arch 50 and a right proximal arch 60. The protective apparatus 10 may further include left shoulder pad 70 and right should pad 80. The proximal and distal arches are preferably fixedly coupled to each other. Left shoulder pad 70 is comprised of left epaulet 100 and left cup 110. Right shoulder pad 80 is comprised of right epaulet 120 and right cup 130. Left shoulder pad 70, left distal arch 30 and left proximal arch 40 may be coupled to form a left portion of protective apparatus 10. Right shoulder pad 80, right distal arch 50 and right proximal arch 60 may be coupled to form a right portion of protective apparatus 10. The left and right portions of protective apparatus 10 can be joined via a swivel 90 and swivel 92 which allow the portions to move closer and farther away from each other laterally (from left to right and right to left). The two portions of the apparatus 10 may also be hinged to each other. In this instance, the swivel 90 and/or 92 limit the lateral and consequently the pivotal movement of the left and right portions. The bottoms of the distal arches may be secured to each other with a belt and buckle assembly. The attachment of each part of the belt and buckle assembly are preferably such that the belt can pivot or otherwise rotate about a hole in the, e.g., distal arches.

Figure 3:
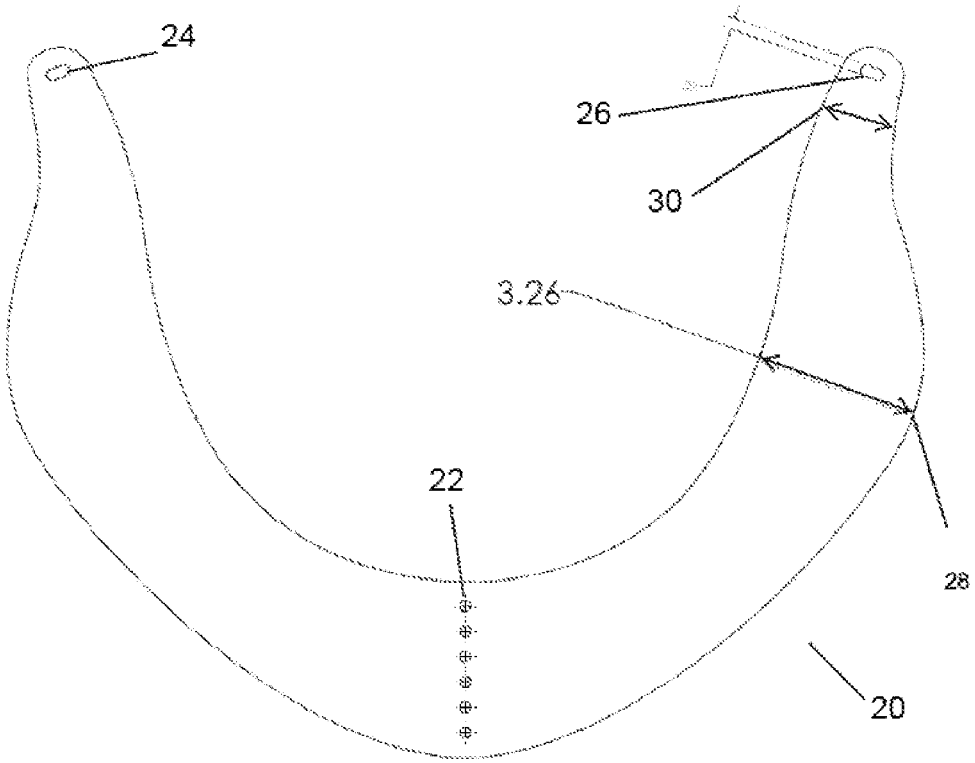
FIG. 3 illustrates a cantilever yoke system according to another embodiment of the present invention.

FIG. 3 presents exemplary dimensions for CYS 20. CYS 20 may be symmetrical in shape, dimension and features about the left and right sides of swivel slots 22. A mid-section width 28 of the right side portion of CYS 20 may be approximately 3.26 inches in width and reduces to about half the width at end-section width 30. The left side portion of CYS 20 may include an identical or substantially similar mid-section width and end-section width. CYS 20 further includes a left arch slot 24 and a right arch slot 26 that are flatten oval-shaped and may measure approximately 0.21 inches in width (between the flattened edges).

Swivel 90 may be attached to CYS 20 via swivel slots 22. FIG. 4A through FIG. 4F present exemplary configurations of swivel 90 with CYS 20 for use with various sizes of protective apparatus 10. The swivel 90 may be connected to the back of left proximal arch 40 and right proximal arch 60. Connection points of CYS 20 (e.g., attachment to swivel slots 22, left arch slot 24, and right arch slot 26) may be attached using stainless steel semi tubular rivets and stainless steel washers, allowing each point of CYS to move freely with respect to the exterior shell of pad. Other mechanisms or attachment means for attaching the CYS (such as screws, nuts and bolts, snaps, etc.) that are well-known in the art are also contemplated as falling within the scope of the present invention.

Figure 2:
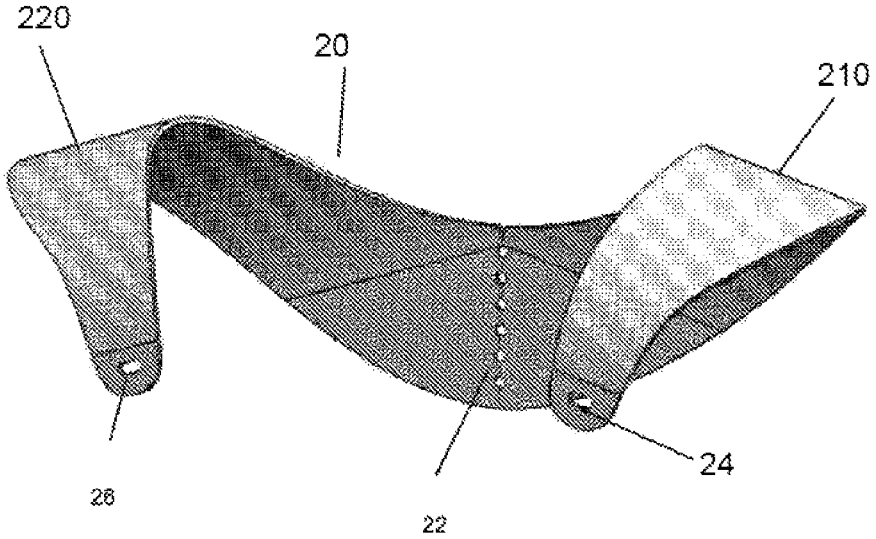
FIG. 2 illustrates a cantilever yoke system according to an embodiment of the present invention.

Referring back to FIG. 2, half inch twelve-pound density shoulder pads and/or a half inch nine-pound density foam body portion are attachable to the bottom (inside 0 of CYS 20 at left apex 210 and right apex 220, although other densities may be incorporated therein. The foam body portions may be removably attached to the bottom of the CYS 20, for example, using hook and loop fasteners. This beneficially allows the foam pads to be adjusted to accommodate the anatomy of various users. In at least one embodiment, dual density foam pads are used. That is, the pads may be comprised of a plurality of different density foam layers, e.g., at 25 lb. layer laminated to a 9 lb. layer. The exterior of the shoulder pads, e.g., left and right epualets, cups, arches, etc., may be laminated with high density foam. Moreover, the foam may be laminated with a low friction membrane. The foam/low friction membrane is preferably fixedly laminated onto the shoulder pads. The CYS provides an integral part of the protective apparatus 10 and acts as an interior harness for most vital areas of the user. The one piece CYS disperses energy from contact throughout the entire shoulder pad, as opposed to a traditional cantilever which disperses energy on only one side of the shoulder pad. Incorporating CYS 20 on a three-point swivel allows the foam shoulder of the pad to take on the same plane as the players shoulders, further allowing the shoulder pad in its entirety to disperse energy 360 degrees from a point of contact.

By separating the front pads from the back pads on both the right and left side of inner foam body allows the protective apparatus 10 to form a natural channel to accommodate a player's shoulder that is accompanied by an adjustable shoulder piece that removably ties the front and back pads together. The adjustable shoulder piece and inner foam bodies can be moved relative to each other to best fit the makeup of a player's shoulder measurements. This allows for infinite adjustability to account for not only the width/thickness of the player's shoulder (trapezius/clavicle), but also the angle of thereof front to back (anterior/posterior) and horizontally. This further allows the shoulder to move more freely. Finally, the stacking of the foam bodies provides for double layers of foam at critical areas (as shown in FIG. 14F). Furthermore, using a quarter to half an inch of foam in body and shoulder foam with certain embodiments allows the protective apparatus 10 to have one inch of foam at a point of highest probability of impact (anterior portion of shoulder) by layering body foam with shoulder foam. Separation of front from back foam also allows the protective apparatus 10 to place body foam on top of the shoulder foam piece by directly attaching to the cantilever yoke system 20. Inversely, a body of foam can be placed underneath shoulder foam where shoulder foam is directly attached to cantilever yoke system 20. In at least one embodiment, the channel created with the padding has a U or horseshoe shape insofar as the channel extends distally a limited amount to provide (additional) coverage to the player's deltoid (as shown in FIG. 14G). The U-shaped pad shown in FIG. 14G may be stacked at the apex of the shoulder below the left and right body portions. In this regard, the anterior and posterior of the shoulders receive three layers of protection, while the trapezius/clavicle are covered by a single layer and the deltoid is covered by a double layer.

FIG. 4A through 4F present swivel configurations on cantilever yoke systems according to embodiments of the present invention. Swivel configurations may vary depending on a size configuration of protective apparatus 10. The swivel 90 may be attached to one or more swivel slots 22 on CYS 20.

The protective apparatus according to embodiments of the present invention may include a two-piece arch system, which creates a single arch that allows both left and right arches to have a spine built from corrugation to run from front of a given arch to back of the given arch that in turn strengthens the shoulder pad. Furthermore, the proximal and distal arches allow for an outside cantilever, as there is a space between the proximal and distal arch at apex of arch. Having a two-piece arch allows one to change the style of the pad (e.g., the cut) by only adjusting the shape of the distal arch while maintaining integrity and/or strength of the arch. The left proximal and distal arches may be identical, substantially identical, or mirror right proximal and distal arches.

By raising the apex of outwardly curving proximal arch, e.g., ⅜ of an inch above the apex distal arch, it creates an exterior cantilever system on both the left and right sides of the pad that dissipates energy from contact away from apex of arch, thus lessoning pressure in the shoulder area upon impact. The way the two piece arches have been cut has allowed the protective apparatus to integrate two natural ventilation areas in the front and back, left and right side of pad. Integrated quarter and half inch corrugation bars may run vertically throughout entire arch, which enables the protective apparatus to use a thinner HDPE (e.g., falling between 0.125" and 0.188"), thereby cutting weight of product while maintaining strength of arches.

Figure 5:
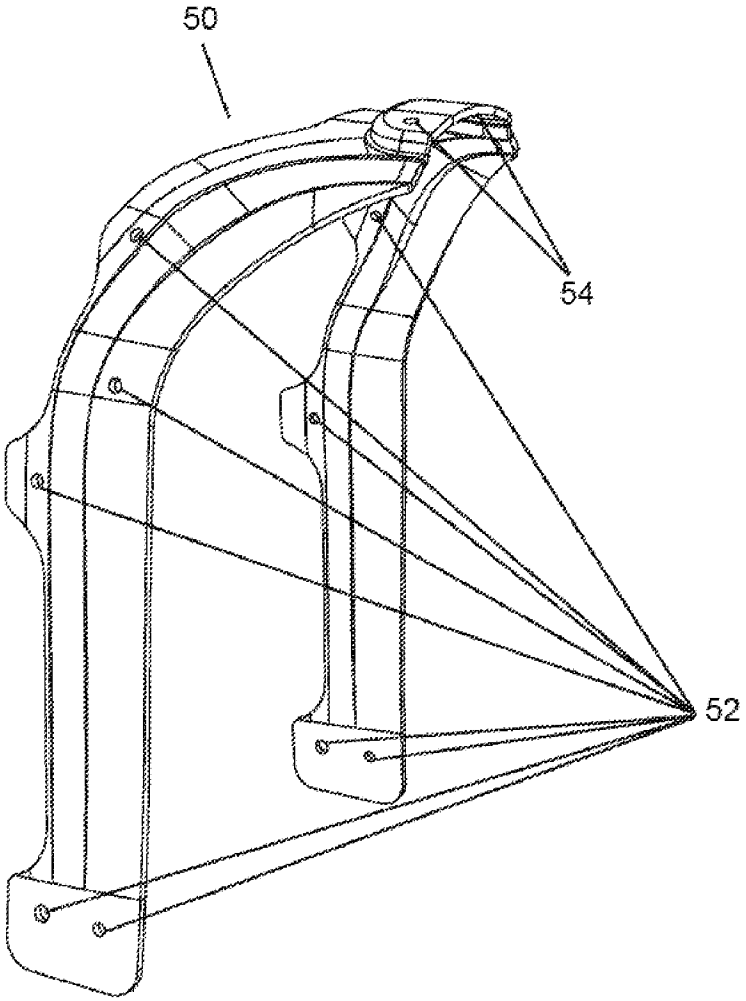
FIG. 5 illustrates a right distal arch according to an embodiment of the present invention.
Figure 9A:
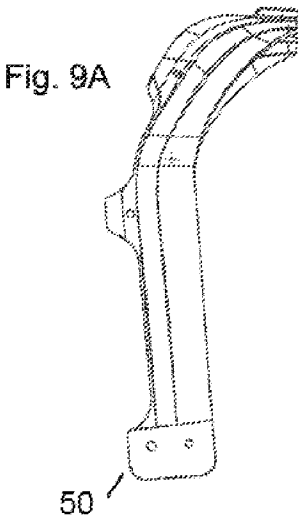
FIG. 9A through FIG. 9C illustrate a right distal arch according to an embodiment of the present invention.
Figure 9B:
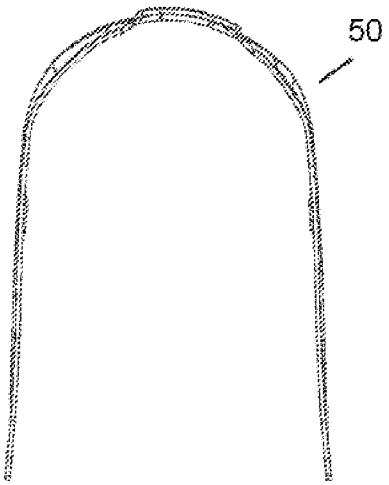
Figure 9C:
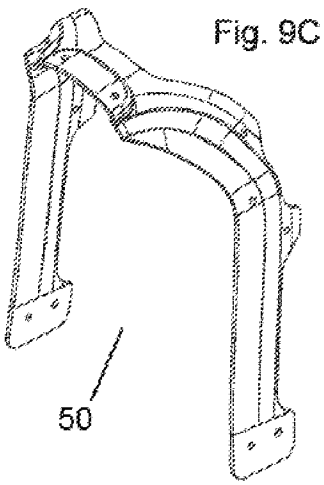
Figure 10A:
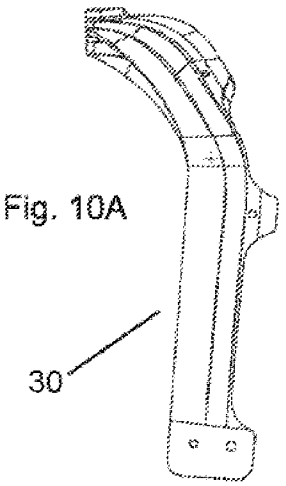
FIG. 10A through FIG. 10C illustrate a left distal arch according to an embodiment of the present invention.
Figure 10B:
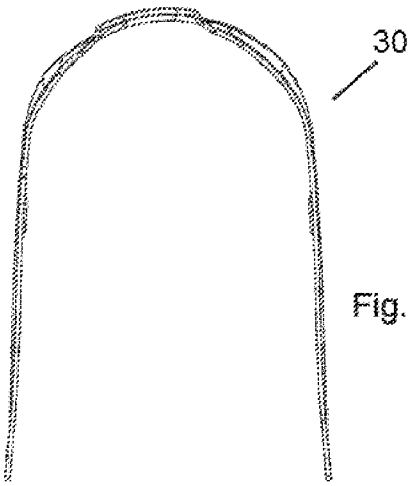
Figure 10C:
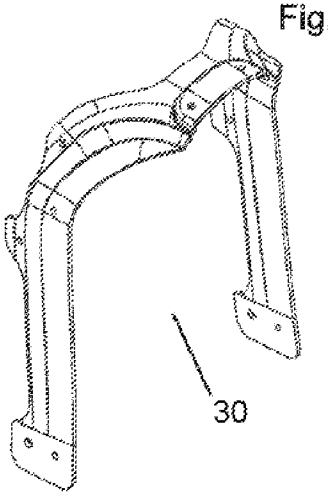
Figure 11:
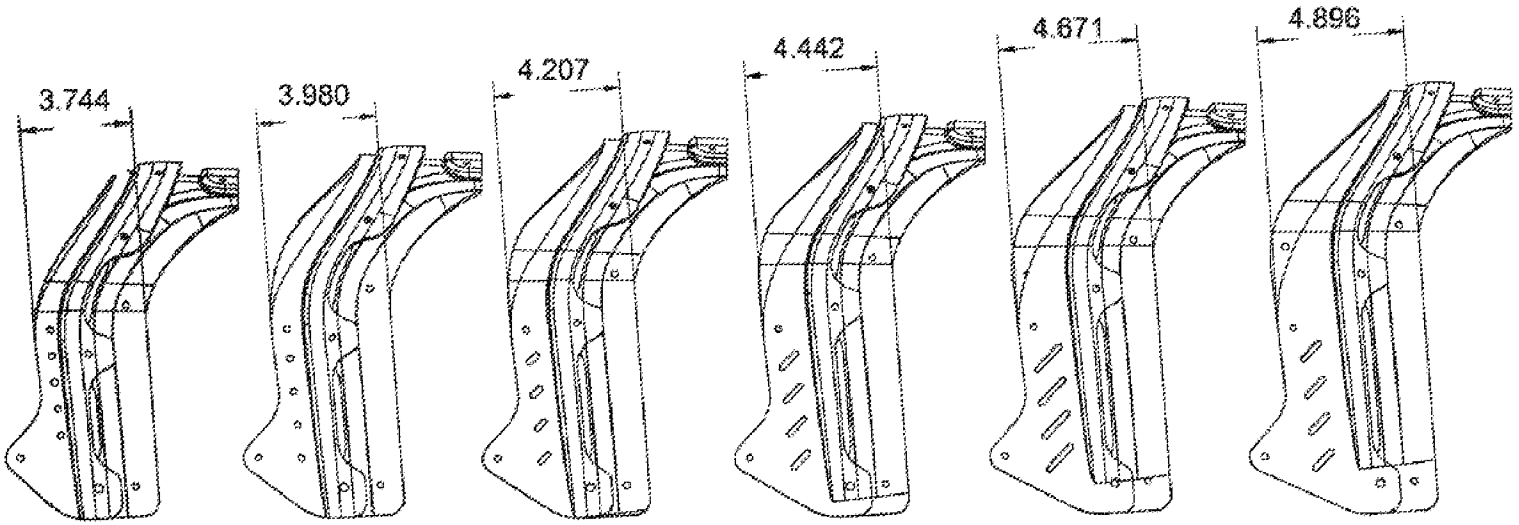
FIG. 11 illustrate right proximal distal arch pairs according to embodiments of the present invention.

FIG. 5 presents a right distal arch 50 according to an embodiment of the present invention. Right distal arch 50 includes a plurality of attachment points 52 and shoulder pad attachment points 54. The right distal arch 50 may be attached with right proximal arch 60 (and CYS 20) at attachment points 52 and secured with attachment means to form a right proximal distal arch pair, as illustrated in FIG. 11. Similarly, attachment means may be used to secure an attachment of right shoulder pad 80 to right distal arch 50 at shoulder pad attachment points 54. Left distal arch 30 may include corresponding features as right distal arch 50 but in opposite or minor-symmetrical construction. FIG. 9A through FIG. 9C present additional views of right distal arch 50 according to an embodiment of the present invention. FIG. 10A through FIG. 10C present views of a corresponding left distal arch 30 according to an embodiment of the present invention.

Figure 6:
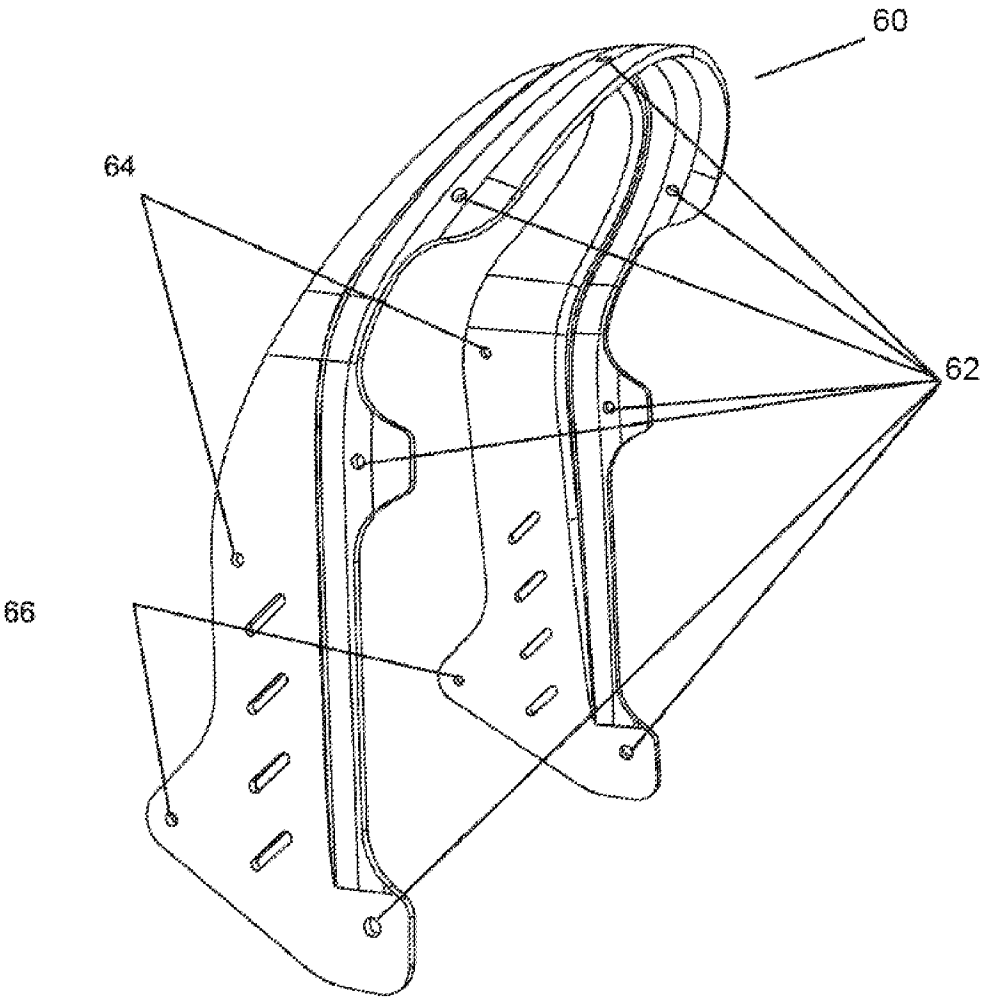
FIG. 6 illustrates a right proximal arch according to an embodiment of the present invention.
Figure 7A:
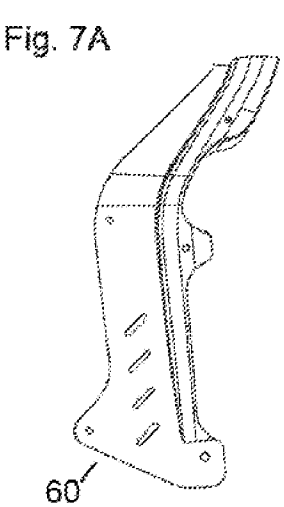
FIG. 7A through FIG. 7C illustrate a right proximal arch according to an embodiment of the present invention.
Figure 7B:
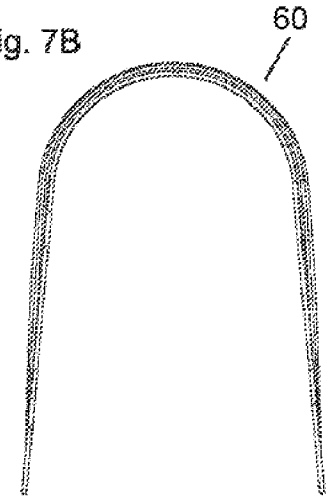
Figure 7C:
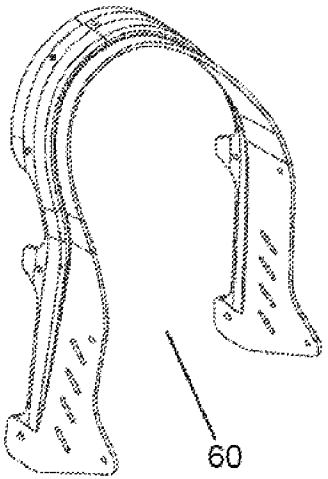
Figure 8A:
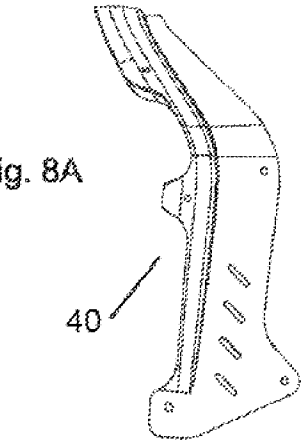
FIG. 8A through FIG. 8C illustrate a left proximal arch according to an embodiment of the present invention.
Figure 8B:
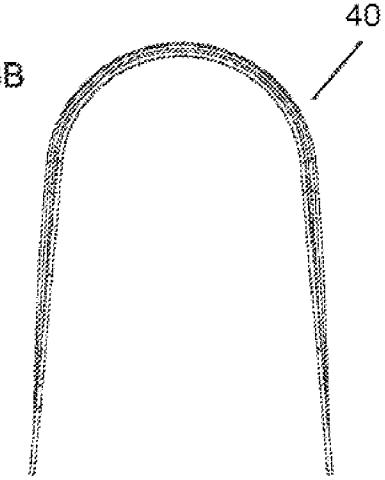
Figure 8C:
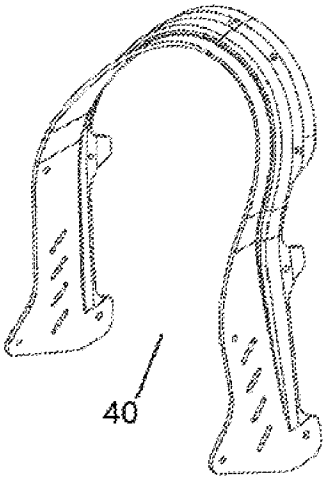

FIG. 6 illustrates a right proximal arch 60 according to an embodiment of the present invention. Right proximal arch 60 includes a plurality of attachment points 62 that provides a securing point with attachment points 52 of right distal arch 50 (which is also attached to CYS 20) using attachment means. Swivel attachment points 64 of right proximal arch 60 may be secured to proximal arch slots on one end of swivel 90 (e.g., on the rear) and swivel 92 (e.g., on the front) also using attachment means. Similarly, attachment means may be used at proximal arch slots on the other end of swivel 90 and swivel 92 to secure an attachment to corresponding swivel attachment points of left proximal arch 40. Right proximal arch 60 further includes left proximal arch attachment points 66 for attachment to corresponding proximal arch attachment points on left proximal arch 40. Left proximal arch 40 may include features and elements of right proximal arch 60 in mirror symmetry. For example, left proximal arch 40 may include a plurality of attachment points for securing with attachment points of left distal arch 30, swivel attachment points, and right proximal arch attachment points to secure an attachment with right proximal arch 60 at the left proximal arch attachment points 66. FIG. 7A through FIG. 7C present additional views of right proximal arch 60 according to an embodiment of the present invention. FIG. 8A through FIG. 8C present views of a corresponding left proximal arch 40 according to an embodiment of the present invention.

Bottom portions of proximal arches 40 and 60 in the front and back may act as an axis by joining extended triangle areas of left and right proximal arches together via attachment means. Attachment means may include stainless steel semi tubular rivet and stainless steel washer and spacer that are used to allow left and right side of pad to move freely, although other mechanisms may be utilized as known to those of skill in the art. The front and back triangle of one proximal arch may be slightly raised above the proximal arch on the opposing side. This allows entire pad to maintain a proper fit and lie flat amongst player's torso. The swivel 90 acts as a bridge between the left and right proximal arches and provides a three-point swivel system for the left and right proximal distal arch pairs. Upon impact it allows both left and right side padding to move simultaneously with the cantilever yoke system 20 and lock into place at end point of slots. This ensures that inner body of pad lies flat against a player's body and that the shoulder pads returns back to original form post-impact.

FIG. 11 presents right proximal distal arch pairs according to exemplary embodiments of the present invention. Right proximal arch 60 may be attached to right distal arch 50 to form a right proximal distal arch pair, as described with respect to FIG. 5 and FIG. 6. A given midsection width of the proximal distal arch pairs may vary according to user sizes. For example, the illustrated midsection width for a small user or a "small" configuration for protective apparatus 10 is approximately 3.744 inches. Approximate midsection width for medium is 3.980 inches, 4.207 for large, 4.442 for XL, 4.671 for XXL, and 4.896 for XXXL.

FIG. 12A presents a side view of a swivel and FIG. 12B illustrates a top view of the swivel according to an embodiment of the present invention. Swivel 90 includes proximal arch slot 1230, proximal arch slot 1240, CYS slot 1210 and CYS slot 1220. Swivel 90 may be approximately 4.25 inches in width and approximately two inches in height. Attachment means may be configured at proximal arch slots 1230 and 1240 to secure an attachment with swivel attachment points of left proximal arch 40 and swivel attachment points of right proximal arch 60.

Figure 15:
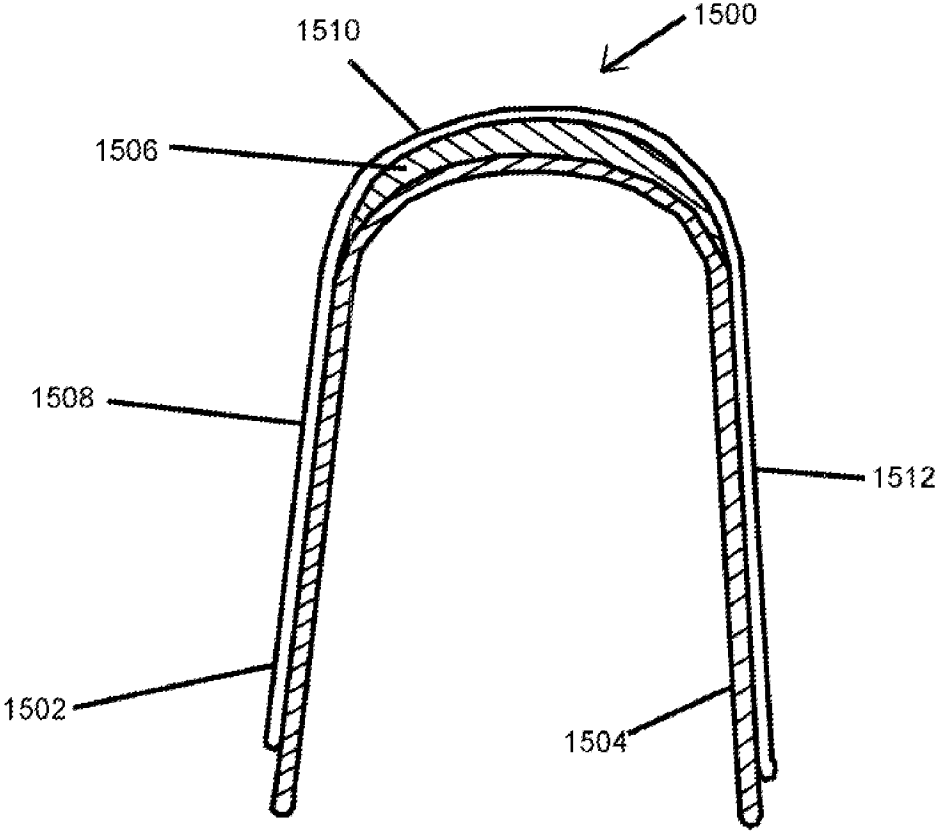
FIG. 15 illustrates a side view of a distal arch foam padding system according to an embodiment of the present invention.

Proximal arch slots 1230 and 1240 may be approximately 0.75 inches in width, 0.25 inches in height, and centered along the axis of the width. Attachment means with a diameter of approximately 0.19 inches may be insertable through proximal arch slots 1230 and 1240. Outside edge distance between proximal arch slot 1230 and proximal arch slot 1240 may be approximately three inches. CYS slot 1210 and CYS slot 1220 may be configured with attachment means to secure with CYS 20 as illustrated in FIG. 4. CYS slots 1210 and 1220 may be comprised of a circular opening including an approximate diameter of 7/32 inches and centered along the axis of the height. The center point of CYS slots 1210 and 1220 may also be offset from the edge of the height by approximately half an inch. According to at least one embodiment, swivel 92 may be identical or similarly scaled to the features and dimensions of swivel 90. In another embodiment, swivel 92 may include a single CYS slot as illustrated in FIG. 15 and FIG. 13B. According to other alternative embodiments, swivel 90 and/or swivel 92 may include any number of CYS slots (e.g., 1, 2, 3, etc.) and any even number of proximal arch slots.

Figure 13A:
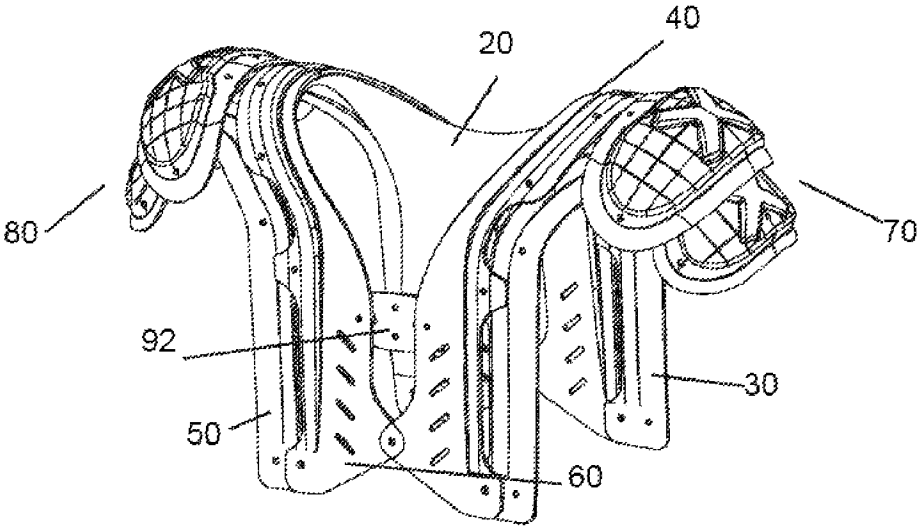
FIG. 13A illustrates a front-left perspective view of a protective apparatus according to an embodiment of the present invention.
Figure 13C:
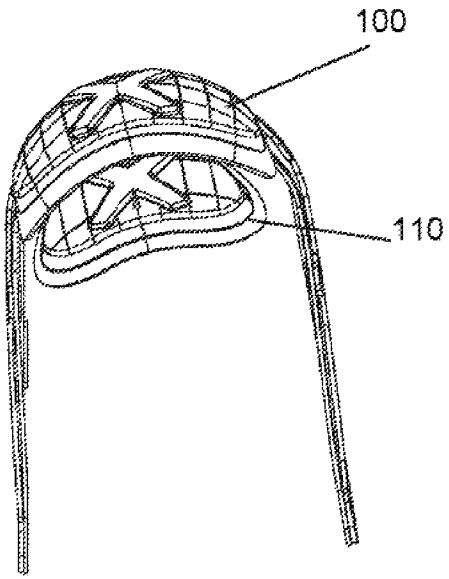
FIG. 13C illustrates a side view of a protective apparatus according to an embodiment of the present invention.
Figure 13B:
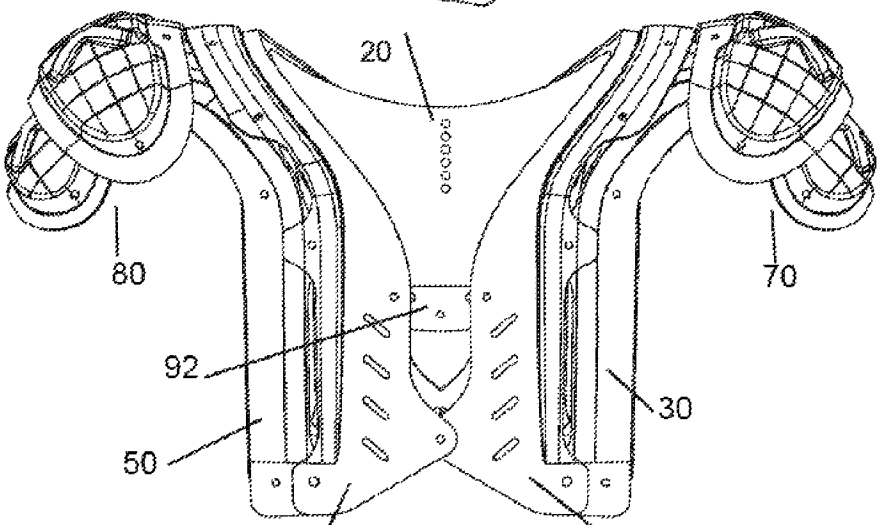
FIG. 13B illustrates a front view of a protective apparatus according to an embodiment of the present invention.

FIG. 13A illustrates a front-left perspective view of a protective apparatus according to another embodiment of the present invention. FIG. 13B illustrates a front view of a protective apparatus according to yet another embodiment of the present invention. FIG. 13C illustrates a side view of a protective apparatus according to an embodiment of the present invention.

FIGS. 14A-F illustrate a multi-piece foam padding system for use with the protective apparatus. The multi-piece foam padding system is generally assembled to fit under an arch portion, as shown in FIG. 14F. That is, a first foam pad 1400 is attached to the bottom or inside of the CYS 20 and/or the arch portion, followed by front 1420 and back 1430 foam padding beneath the first foam pad 1400. These pads are preferably removably attached to each other and/or the CYS/arch portion, for example, with hook and loop fasteners to accommodate the adjustability, as described herein.

Referring back to FIG. 14A, a top view of a first foam shoulder pad 1400 is shown. The first foam pad is preferably shaped to follow or otherwise approximate the cantilever shape of the CYS 20/arch portion. That is, the pad 1400 is asymmetrical relative to the front-back axis, such that when folded about the lateral axis to fit under the arch portion (as shown in FIG. 14F), a cantilever is formed. The pad 1400 preferably has a first and a second hinge 1404, 1406 that facilitates bending about the lateral axis. In this regard, these hinges may be essentially parallel to each other. The hinges 1404, 1406 may be spaced apart from about 1 inch to about 3 inches, and may be symmetrically spaced about the lateral axis. The first pad 1400 may have third 1402 and fourth 1408 hinges. The hinges 1404, 1406 may be spaced from the first 1404 and second 1406 hinges from about 1.5 inches to about 3.5 inches, and may be symmetrically spaced about the lateral axis. The first foam shoulder pad 1400 preferably has a curve 1410 between the lateral and front-back axis that mirrors that of the left and/or front and rear body pads. When referring to hinges for the pads, the term includes mechanical hinges as well as discrete recesses in the padding that allow the pads to fold along the recess.

Figure 14A:
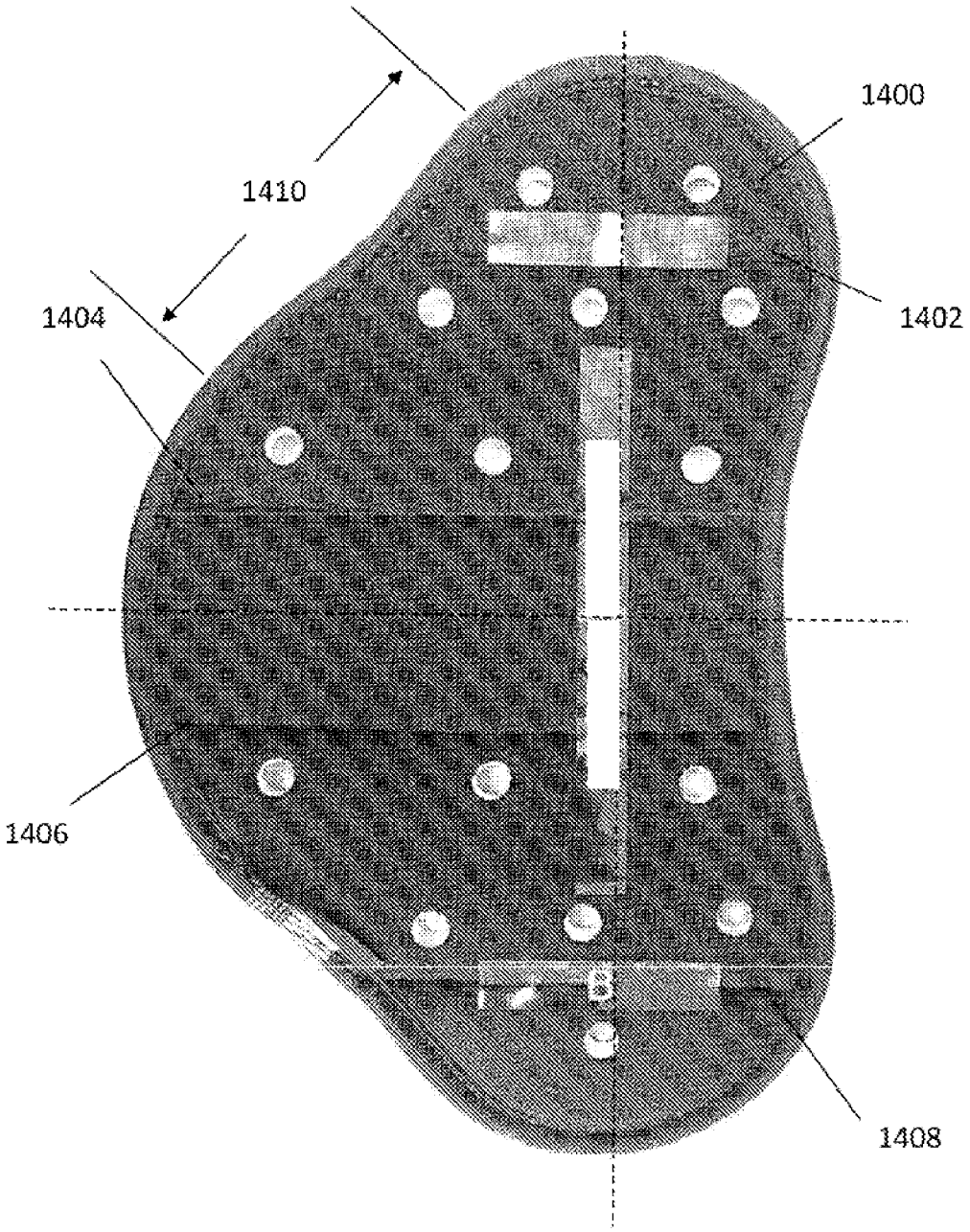
FIG. 14A-14G illustrate a multi-piece foam padding system according to an embodiment of the present invention.
Figure 14B:
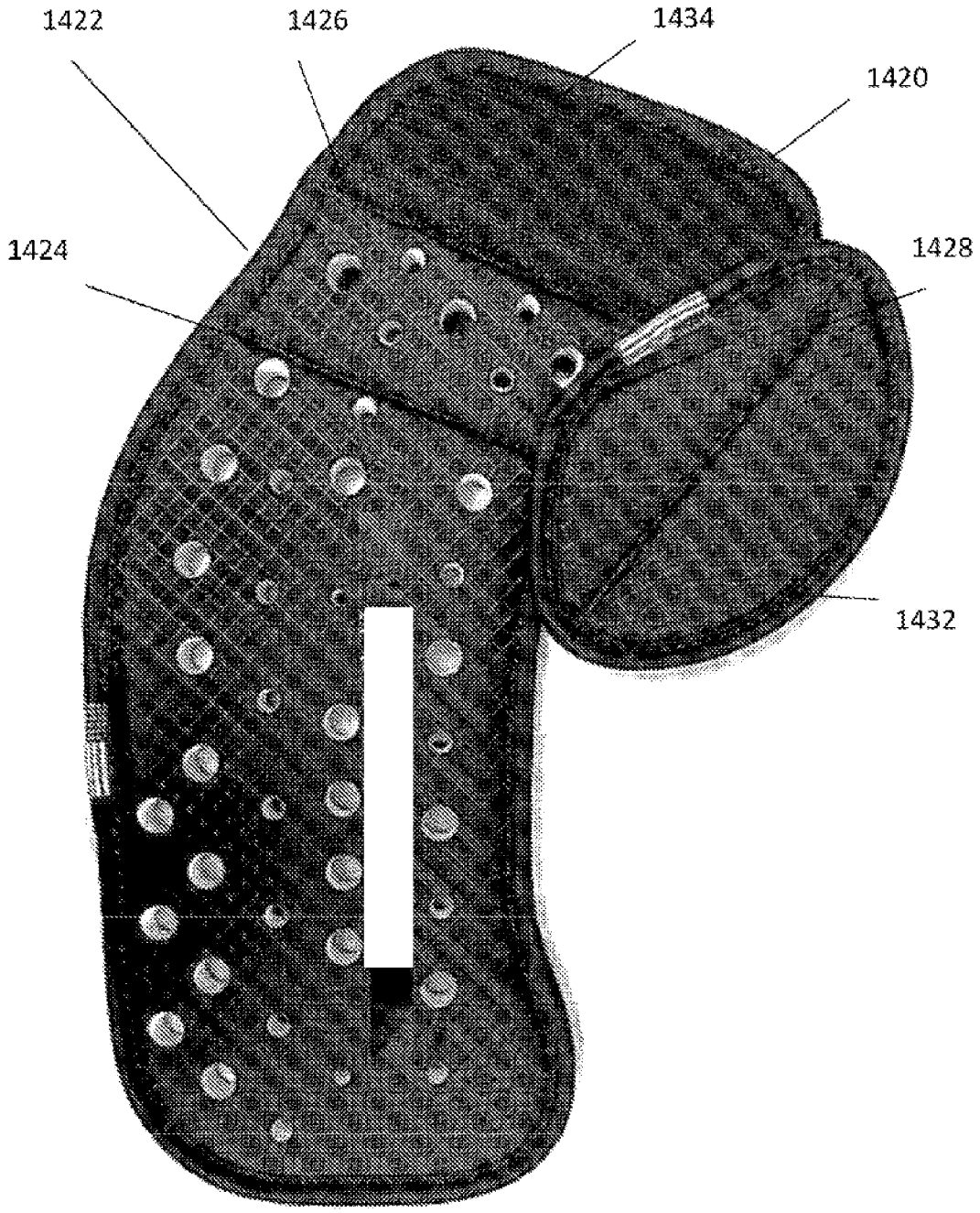
Figure 14C:
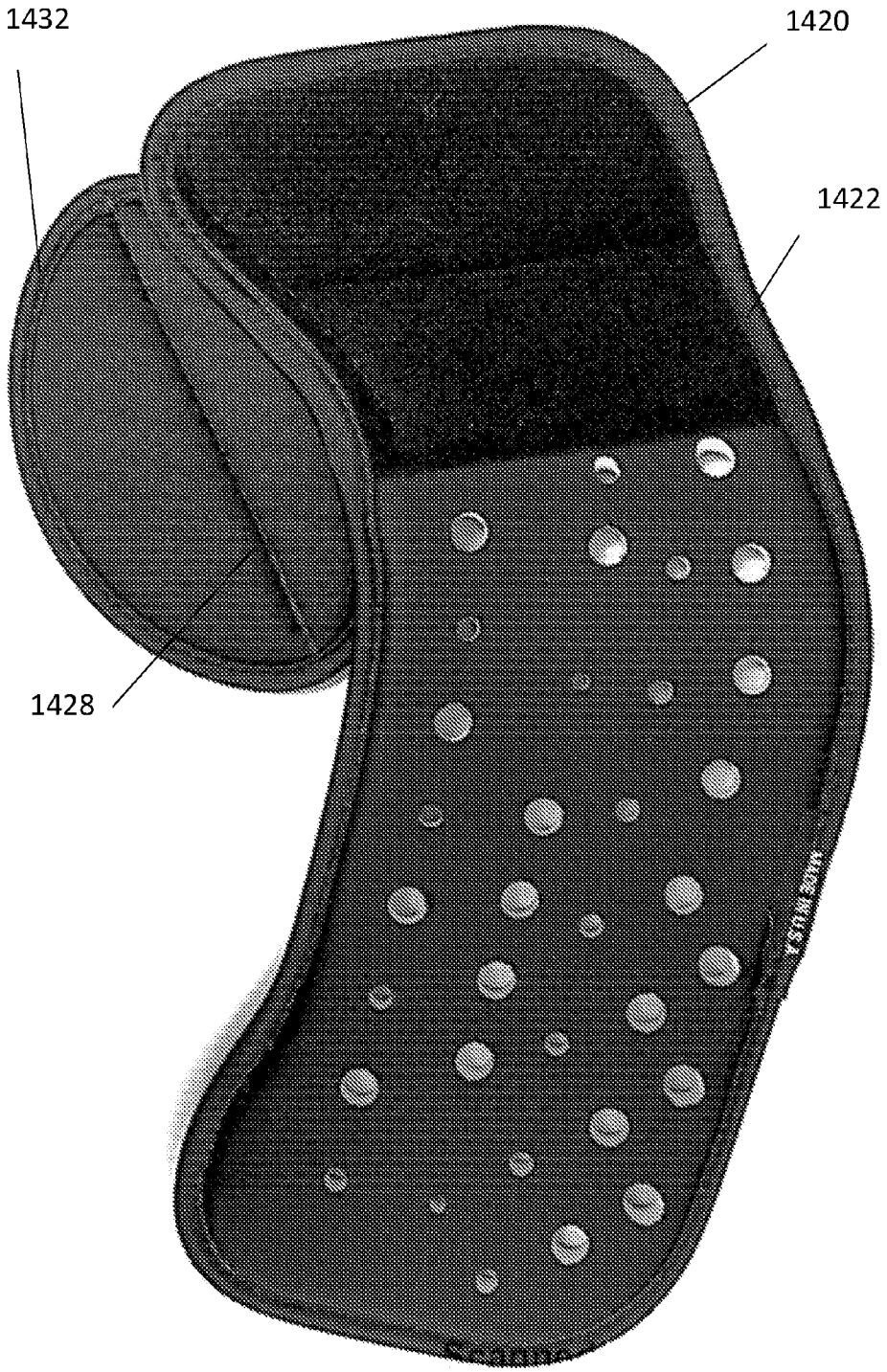

FIG. 14B is a front view and 14C is a rear view of a front body foam pad 1420. The front body foam pad 1420 has a shape that generally mirrors the general shape of the arch portion to which it is attached. For instance, a left body pad is shown having a shape that is essentially straight from the bottom to the top, then skews or bends toward the right to mirror or otherwise resemble the cantilever of the left arch portion. This foam pad 1422 preferably includes a first and second hinge 1424, 1426. These hinges may be spaced apart the same as the hinges in the shoulder pad 1400. The hinge 1426 may delineate a hook and loop section 1434 for attaching the body pad 1420 to the shoulder pad 1400. The front body foam pad 1420 preferably includes an extension pad 1432 attached thereto at a distal edge of the pad 1420. The extension pad 1432 may include a hinge 1428, which may be essentially parallel or otherwise in line with the proximal edge 1422 of the body pad 1420. As can be seen, the hinges 1424, 1426 are skewed or angled relative to horizontal. Moreover, the front pad 1420 may include a plurality of apertures that preferably align with the apertures in the arches for ventilation.

Figure 14D:
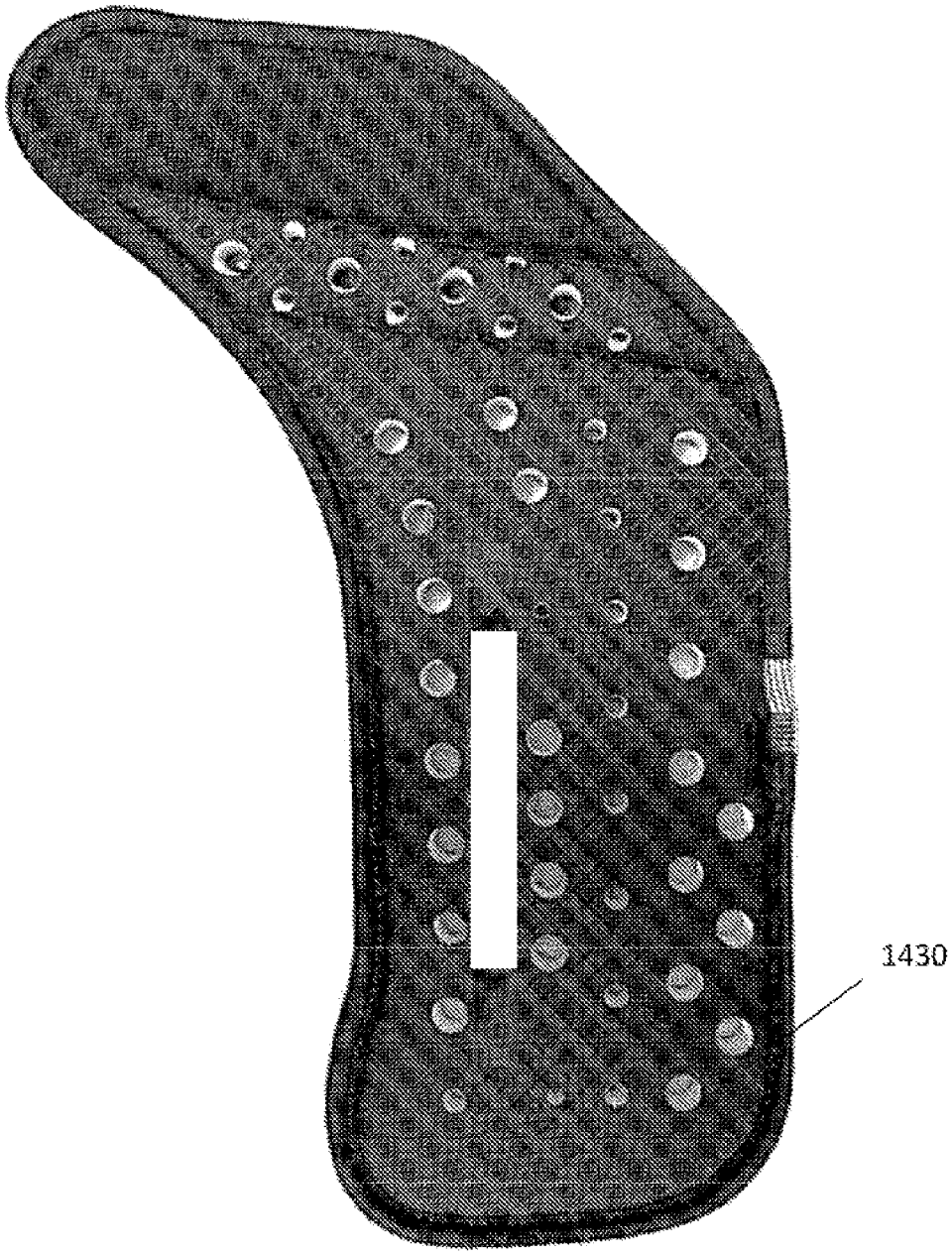
Figure 14E:
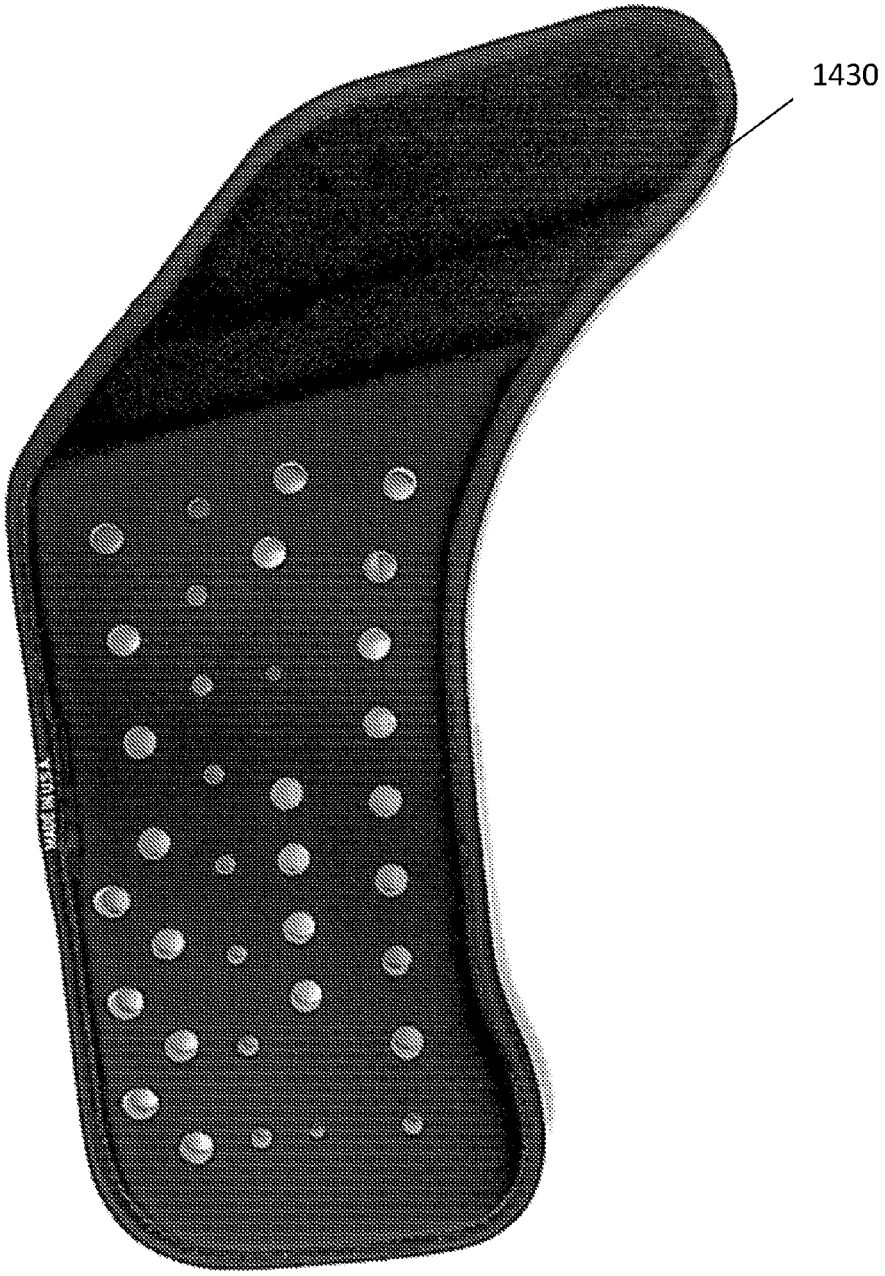
Figure 14F:
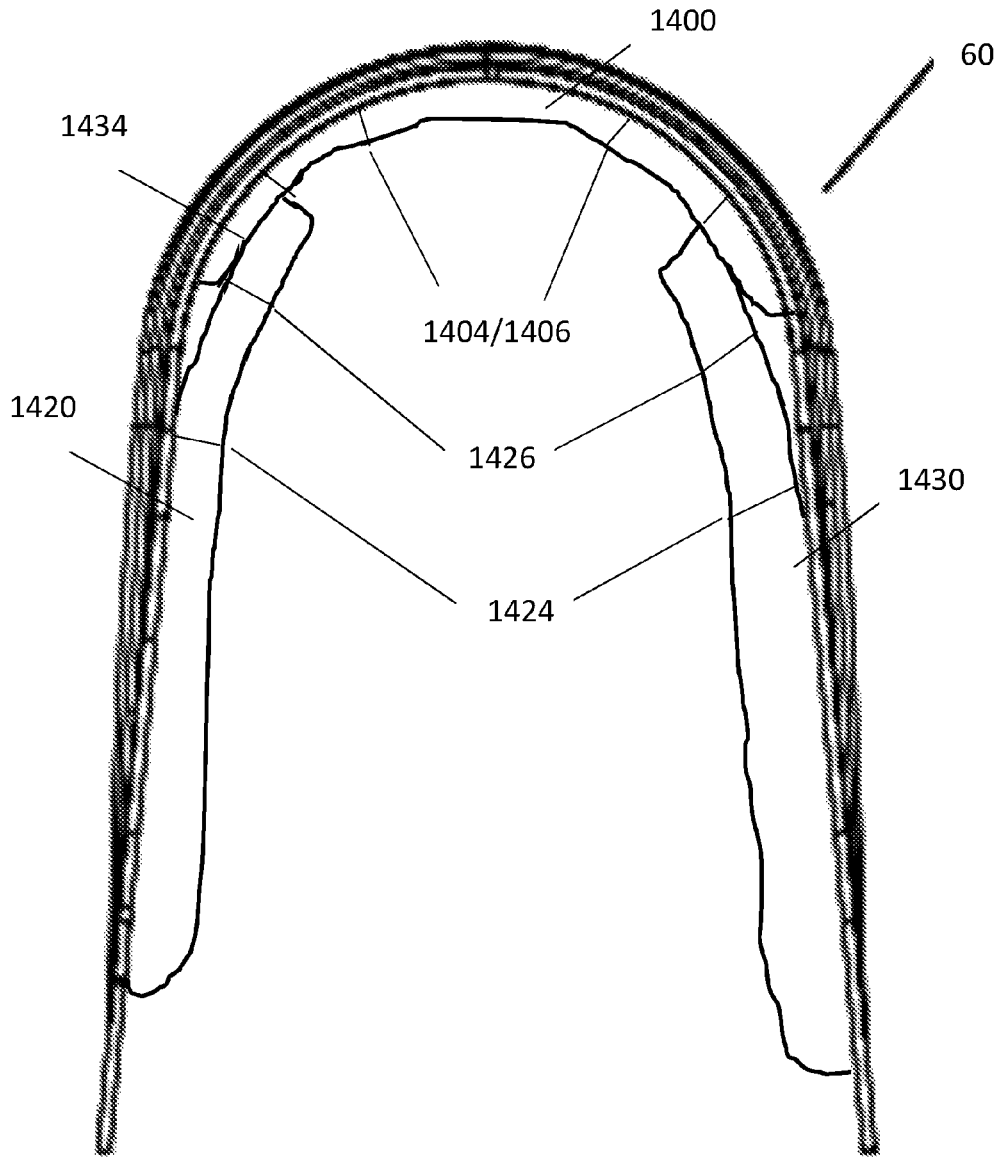
Figure 14G:
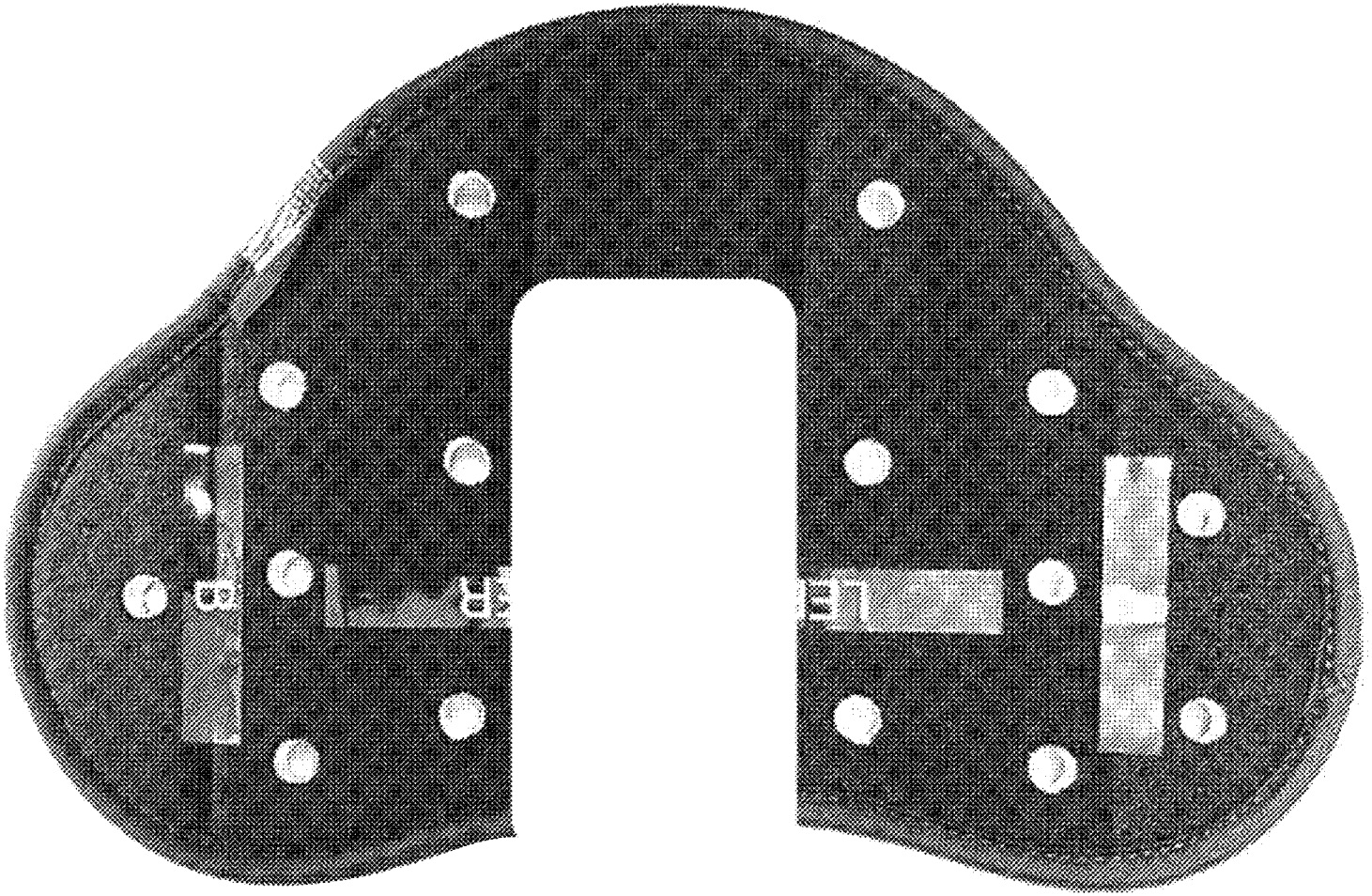

FIG. 14D is a front view and 14E is a rear view of a rear body foam pad 1430. The rear body foam pad 1420 generally has the same shape as the front body pad 1420, as shown, including the location of the hinges and hook and loop section. The apertures in the rear body foam pad 130 may similarly be aligned with apertures/holes in the arches for ventilation.

FIG. 14F is a side view of the arch portion with the foam pads installed. As can be seen, the shoulder pad 1400 is preferably removably attached to the upper most portion of the arch portion and/or CYS 20, followed by the body pads 1420, 1430 removably attached to respective sides of the arch portion at the bottom end and to the shoulder pad 1400 at the top end. This allows users to tailor the size of the recess between the upper ends of the body pads to accommodate different size and shape shoulders, as discussed herein.

FIG. 14G a top view of a second, U-shaped foam shoulder pad. This shape accommodates the user's shoulder anatomy while providing coverage for at least a portion of the user's deltoid. As discussed herein, this pad may be a substitute for the first pad 1400 or may be used in addition to the first pad 1400. Preferably, the U-shaped pad is stacked at the apex below the upper ends of the left and right body foam pads 1420, 1430, and thus below the first foam pad 1400.

The multi-piece padding system(s) described herein provide several benefits, including providing a channel fully adjustable to accommodate natural shape of the user's acromioclavicular joint (AC Joint); the ability to adjust the angle of the front and back body pads relative to each other at the upper ends to keep the AC joint channel constant according to the mid-line of the correlation between the mid-neck and glenohumeral head; the ability to spread the front and back body pads apart to make a wider AC joint channel to allow the pad to sit at a lower profile on the wearer's body; by keeping the shoulder pad isolated from the other pads in the system, the user's shoulder can be positioned (moved or slid forward/backward, proximally/distally) by adjusting the location of the channel to achieve the optimum placement for the maximum protection on each wearer; also, by keeping the shoulder pad isolated in the system, the thickness of the shoulder pad can be changed, without altering the front or back cushions, to the desired level of protection based upon a players position or history of injuries; the 3-piece system as shown allows for a double-layer of foam/cushion over the clavicle area in the front and the scapula area in the back; and the setup show in FIG. 14F can also be inverted where the shoulder pad is in contact with the wearer's body and the channels are inverted to the top side of the shoulder piece. With regard to the shoulder pad shown in FIG. 14G, an insertable/removable extra cushion that can to be placed in the shoulder area in conjunction with the shoulder pad 1400, creates a deeper channel to allow for over-developed trapezius muscles to fit into the channel properly. Additionally, the design allows for the midpoint when inserted to fill in the gap at the outer-edge of the shoulder or above the glenohumeral head created by the over-developed trapezius muscles.

FIG. 15 presents a side view of a distal arch with foam pads according to at least one embodiment installed. As illustrated, distal arch 1500 may include a one-piece foam body cushion 1504 (as opposed to the multi-piece system shown in FIG. 14 F) that is preferably removably attached to a plastic arch 1502 along an entirety or a majority of body cushion 1504. The one-piece foam body cushion 1504 is generally assembled to fit under plastic arch 1502, but may otherwise have the same or similar shapes as the front and rear body cushions discussed and shown herein, for example, in FIGS. 14B-E. The plastic arch 1502 may comprise three separate pieces, as discussed herein. For example, distal arch 1500 may be a left-side arch that includes a front blade 1508, an arch 1510, and a back blade 1512. The body cushion 1504 may comprise one continuous piece from the bottom of the front blade 1508, over the shoulder at arch 1510, and continuing on to the bottom of the back blade 1512. A right-side distal arch may be similarly constructed that mirrors the left-side arch.

The distal arch 1500 may further include a shoulder cushion section area 1506 that may be situated above arch 1510 that is over the shoulder. This area 1506 may be a void maintained by attaching the one-piece foam cushion 1504 so as to maintain the portion of the cushion 1504 over the user's shoulder in tension. An additional cushion (not illustrated) of variable thickness and/or material may be removably attached to plastic arch 1502 in the area 1506 to disperse a majority of shock in the shoulder padding area. The cushion may be removably attached to the distal arch 1500 at the shoulder cushion section area 1506, for example, with hook and loop fasteners to accommodate adjustability. This additional cushion, preferably has a cross section mirroring that of the area 1506. More specifically, this additional cushion may have tapered ends at the front and rear as in the section of area 1506 shown.

FIGS. 1 through 15 are conceptual illustrations allowing for an explanation of the present invention. Notably, the figures and examples above are not meant to limit the scope of the present invention to a single embodiment, as other embodiments are possible by way of interchange of some or all of the described or illustrated elements. Moreover, where certain elements of the present invention can be partially or fully implemented using known components, only those portions of such known components that are necessary for an understanding of the present invention are described, and detailed descriptions of other portions of such known components are omitted so as not to obscure the invention. In the present specification, an embodiment showing a singular component should not necessarily be limited to other embodiments including a plurality of the same component, and vice-versa, unless explicitly stated otherwise herein. Moreover, applicants do not intend for any term in the specification or claims to be ascribed an uncommon or special meaning unless explicitly set forth as such. Further, the present invention encompasses present and future known equivalents to the known components referred to herein by way of illustration.

The foregoing description of the specific embodiments will so fully reveal the general nature of the invention that others can, by applying knowledge within the skill of the relevant art(s) (including the contents of the documents cited and incorporated by reference herein), readily modify and/or adapt for various applications such specific embodiments, without undue experimentation, without departing from the general concept of the present invention. Such adaptations and modifications are therefore intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one skilled in the relevant art(s).

While various embodiments of the present invention have been described above, it should be understood that they have been presented by way of example, and not limitation. It would be apparent to one skilled in the relevant art(s) that various changes in form and detail could be made therein without departing from the spirit and scope of the invention. Thus, the present invention should not be limited by any of the above-described exemplary embodiments, but should be defined only in accordance with the following claims and their equivalents.

What is claimed is:

1. A protective apparatus comprising:

a left generally arched shaped portion;

a right generally arched shaped portion; and a foam padding system comprising a shoulder pad removably attached to at least one of the generally arched shaped portions, and a pair of body pads removably attached at a top end to the shoulder pad and at a bottom to a bottom end of the at least one of the generally arched shape portions, wherein the shoulder pad comprises a plurality of hinges.

2. The protective apparatus of claim 1, wherein the protective apparatus comprises a cantilever yoke system attached to a front of each of the left and right generally arched shaped portions, and wherein the shoulder pad is removably attached to an inside of the cantilever yoke system.

3. The protective apparatus of claim 1, wherein the plurality of lateral hinges are essentially parallel to a lateral axis of the shoulder pad.

4. The protective apparatus or claim 3, wherein the plurality or hinges are equally spaced from the lateral axis.

5. The protective apparatus of claim 4, wherein the plurality of hinges are spaced about 1 inch to about 3 inches from each other.

6. The protective apparatus of claim 1, wherein each of the generally arched shape portion extends outwardly to form a cantilever section, and wherein the shoulder pad is shaped to form a cantilever shape when folded about a lateral axis of the shoulder pad that follows the cantilever shape or the arch.

7. The protective apparatus of claim 1, wherein each of the generally arched shape portion extends outwardly to form a cantilever section, and wherein the pair of body pads comprise a front body pad having a shape that follows the cantilever shape of the arch.

8. The protective apparatus of claim 7, wherein the front body pad comprises an extension pad attached to a distal end thereof, and wherein the extension has a hinge that is essentially parallel to a proximal edge of the body pad.

9. The protective apparatus of claim 7, wherein the front body pads comprise a plurality of hinges at an upper end of the pad that are essentially parallel with a lateral axis of the shoulder pad.

10. The protective apparatus or claim 9, where at least one or the plurality or hinges delineates a hook and loop section for attaching the body pad to the shoulder pad.

11. The protective apparatus of claim 1, comprising: one or more swivels having a plurality of elongated slots therein, the left generally arched shaped portion pivotally coupled to the right generally shaped portion at an attachment point at least one of a front and a rear of the apparatus, the one or more swivels slidingly coupled to the left generally arched shaped portion via a first of the elongated slots and to the right generally arched shaped portion via a second of the elongated slots, the plurality of the elongated slots limit pivotal movement about the attachment point.

12. The protective apparatus of claim 11, wherein at least one of the left and right generally arched shape portions comprise a distal arch coupled to a proximal arch, and wherein the at least one shoulder pad is coupled to the distal arch.

13. The protective apparatus of claim 11, comprising a cantilever yoke system having a left arch slot, a right arch slot, and one or more swivel slots, the left generally arched shaped portion slidingly coupled to the cantilever yoke system at the left arch slot, the right generally arched shaped portion slidingly coupled to the cantilever yoke system at the right arch slot, and the one or more swivels coupled to the cantilever yoke system at the one or more swivel slots, and wherein slots in at least one of the cantilever yoke system and in the left and right generally arched shaped portions further limit pivotal movement of the left and right portions.

14. The protective apparatus or claim 13, wherein the one or more swivels connect the left and right portions of the apparatus to each other on a rear of the left and right portions, the cantilever yoke system further coupled to at least one of the one or more swivels on a rear of the apparatus at the one or more swivel slots.

15. The protective apparatus of claim 13, wherein the cantilever yoke system acts as a bridge between left and right portions of the apparatus to transfer an impact on one of the left and right portions to the other of the left and right portions.

16. The protective apparatus of claim 1, wherein each of the left and right portions comprise a distal and a proximal arch fixedly coupled to each other and wherein an apex or the proximal arch is located above an apex of the distal arch such that a space is maintained between the proximal and distal arches.

17. The protective apparatus of claim 16, wherein the apex of each of the proximal and distal arches curves laterally outward such that apexes of the proximal and distal arches form an external cantilever system.

18. The protective apparatus of claim 1, comprising a second generally U-shaped shoulder pad layered below the right shoulder pad.

19. The protective apparatus of claim 1, wherein at least one of the first and second body portions have a plurality of apertures therein that align with a plurality of apertures in the generally arch shaped portions.

* * * * *